US005461742A

United States Patent [19]

Pasad et al.

[11] Patent Number: 5,461,742

[45] Date of Patent: Oct. 31, 1995

[54] MIST TREATMENT OF GARMENTS

[75] Inventors: Dilip Pasad; Frank Garcia, both of El Paso, Tex.

[73] Assignee: Levi Strauss & Co., San Francisco, Calif.

[21] Appl. No.: 198,195

[22] Filed: Feb. 16, 1994

[51] Int. Cl.[6] ..... D06B 3/30

[52] U.S. Cl. ..... 8/149.2; 34/517; 68/5 C

[58] Field of Search ..... 8/149.1, 149.2, 8/158; 68/5 C; 34/517, 389

[56] References Cited

U.S. PATENT DOCUMENTS

| | | | |
|---|---|---|---|
| 1,683,687 | 9/1928 | Mijer | 8/149.2 |
| 1,948,568 | 2/1934 | Faber et al. | 68/5 C X |
| 2,023,013 | 12/1935 | Faber et al. | 8/149.1 X |
| 3,103,450 | 9/1963 | Janson | 68/5 C |
| 3,811,300 | 5/1974 | Barton et al. | 68/12 R |
| 4,204,339 | 5/1980 | Muller | 34/75 |
| 4,218,220 | 8/1980 | Kappler et al. | 8/102 |
| 4,432,111 | 2/1984 | Hoffmann et al. | 8/158 |
| 4,519,223 | 5/1985 | Waseman | 68/23.5 |
| 4,575,887 | 3/1986 | Viramontes | 8/158 |
| 4,580,421 | 4/1986 | Babuin et al. | 68/12 R |
| 4,696,171 | 9/1987 | Babuin | 68/207 |
| 4,809,524 | 3/1989 | Sickert et al. | 68/148 |
| 4,845,790 | 7/1989 | Brasington | 8/150 |
| 4,858,449 | 8/1989 | Lehn | 68/12 R |
| 4,862,546 | 9/1989 | von Der Eltz et al. | 8/149.1 |
| 4,941,333 | 7/1990 | Blessing | 68/19.2 |
| 4,984,317 | 1/1991 | Christ | 8/149.1 |
| 5,006,126 | 4/1991 | Olson et al. | 8/401 |
| 5,190,562 | 3/1993 | Dickson et al. | 8/111 |
| 5,191,669 | 3/1993 | Euler et al. | 8/158 |
| 5,213,581 | 5/1993 | Olson et al. | 8/401 |
| 5,215,543 | 6/1993 | Milora et al. | 8/102 |
| 5,235,828 | 8/1993 | Aurich et al. | 68/62 |

FOREIGN PATENT DOCUMENTS

| | | | |
|---|---|---|---|
| 0315879A1 | 5/1989 | European Pat. Off. | D06F 58/20 |
| 2-302300 | 12/1990 | Japan | D06F 58/04 |
| 4-033698 | 2/1992 | Japan | D06F 58/04 |
| 551809 | 7/1974 | Switzerland | 68/5 C |

OTHER PUBLICATIONS

Encyclopedia of Chemical Technology, vol. 13, pp. 856–907, Kirk & Othermer Ed., (1954).

Kirk–Othermer Encyclopedia of Chemical Technology, Third Edition, vol. 22, pp. 762–802 (1983).

*Primary Examiner*—Philip R. Coe

*Attorney, Agent, or Firm*—Haverstock, Medlen & Carroll

[57] ABSTRACT

An apparatus and method for applying textile treatment finishing agents to garments or garment work pieces is provided. The apparatus includes a rotating drum and a nozzle for generating a fine mist or fog of textile treatment agents inside the rotating drum. The apparatus can be constructed as a dedicated processing machine, or a conventional, industrial washer or dryer can be fitted with an appropriate nozzle and feed lines to provide a dual purpose machine which can be used for its originally intended purpose, and can be selectively used for applying textile treatment agents. Uniform coverage of the surface of the garment is assured by tumbling the garments through the fog created by the nozzle means. By controlling the size of the droplets, and the time during which mist or fog is generated, the amount of chemical agent absorbed by the garments can be controlled. The use of the finely divided, air dispersed liquid agent avoids wasted processing chemicals and permits the use of more concentrated chemical agents.

20 Claims, 3 Drawing Sheets

MIST TREATMENT OF GARMENTS

BACKGROUND OF THE INVENTION

In the processing of textiles it is a common practice to use chemicals and processing techniques to affect the fabric's physical and chemical characteristics. An excellent summary of textile processing techniques is provided in TEXTILE TECHNOLOGY, Encyclopedia Of Chemical Technology, Edited by R. E. Kirk & D. F. Othmer, 13, 856–907 (1954). The garment industry uses chemicals and processing techniques commonly referred to in the industry as "finishing," to achieve garment characteristics which are desired by the consumer. Commonly, these characteristics relate to the appearance, washability or softness of the garment. For example, U.S. Pat. No. 4,218,220 to Kappler et al. discloses a process for treating blue jeans to obtain a pre-faded appearance, by subjecting the garments to a washing cycle using bleach, fabric softener and detergent. U.S. Pat. No. 4,575,887 to Viramontes discloses a process for washing garments with abrasive particles for a "stone-washed" appearance. Typically these treatment steps are carried out as immersion processes in conventional, industrial two-drum washing machines such as, for example, a UniMac rotary, front-loading type washer, or in a single drum fabric finishing machine such as that disclosed in U.S. Pat. No. 4,941,333 to Blessing.

A "stone-washed" appearance of denim garments is of particular interest to the garment industry since the faded look and soft feel have great consumer appeal. It is well known to those skilled in the art that the "stone-washed" look and softness of garments can be achieved through agitating the wet garment in contact with pumice stones. U.S. Pat. No. 4,845,790 to Brasington discloses garment treatment techniques in which the use of pumice is combined with the use of bleach.

A number of serious drawbacks are associated with the use of pumice for garment treatment such as: (1) inability to accurately control the abrasion of the garment to achieve the desired "look", (2) lack of consistency in appearance and softness between different batches of treated garments, (3) excessive wear of equipment used for stone washing, (4) requirement for extensive rinse cycles to remove pumice rock from the creases of the garments, (5) need for hand-removal of pumice from the pockets of garments, (6) disposal of abraded pumice. For a description of these well known problems, see, for example U.S. Pat. No. 5,006,126 to Olson et al. Accordingly, extensive efforts have been made to achieve a "stone-washed" effect without the disadvantages associated with the use of pumice rock.

U.S. Pat. No. 5,190,562 to Dickson et al., for example, teaches the preparation and use of a chemical bleaching agent absorbed on an inert carrier (e.g. diatomaceous earth) for denim garment treatment to obtain a faded appearance. The dry powder is tumbled with wet garments, followed by rinsing and drying. While avoiding the use of pumice, the method does not solve the problems of disposal of spent carrier and extensive rinse cycles required to remove carrier from garment seams and pockets. U.S. Pat. No. 5,215,543 to Milora et al. teaches the use of stones for garment abrading in which the stones have a chemical composition that is soluble in rinse water. Compared with the use of pumice this technique is claimed to result in easier removal of the residue from garments and processing equipment. However it does not solve the spent product disposal and equipment abrasion problems.

U.S. Pat. No. 5,213,581 to Olson et al. teaches the use of aqueous cellulase enzyme compositions to provide a "stone-washed" appearance. Use of abrasive or solid materials is completely avoided by this technique. The garment is exposed to a cellulase enzyme composition by agitating the garment in an aqueous solution. The patent discloses that cellulose is removed from the fabric as a result of this treatment. Disadvantages of this type of treatment are: (1) the breakdown of the fabric as a result of cellulose removal (2) the need for stringent control of pH and temperature since the cellulase enzymes work efficiently in a narrow pH and temperature range; and (3) the neutralization and disposal of excess cellulase enzyme compositions present in the fabric and in the excess solution contained in the processing equipment.

Further, aqueous treatment steps such as those employed by Olson and those who use bleaches, pumice or aqueous treatment agents such as dyes, fabric softeners, or permanent press type fabric finishes, are generally carried out through immersion and agitation of the garment in a treatment solution. However, serious disadvantages are associated with any aqueous immersion treatment technique because they require: (1) dilution of treatment agents to prevent excess concentration on random parts of the treated garment leading to uneven or unsightly effects, (2) energy to move or agitate the diluted treatment agent during treatment; and, (3) treatment and/or disposal of treatment agent solution after processing.

U.S. Pat. Nos. 5,235,828 to Aurich et al. and 4,984,317 to Christ teach aqueous textile treatment methods utilizing smaller quantities of liquid to achieve the desired treatment without an excess of treatment agent. Aurich '828 sprays a treatment agent onto lengths of fabric in endless rope form which circulates through a predetermined path in a special treatment chamber. A recirculating liquid jet is used to move the fabric rope and to expose the fabric to the treatment agent. In the Christ '317 patent, fabric is wound on spools and placed in a vessel. A gas stream, containing treatment agent in dispersed form, is forced through the spooled fabric. The gas stream provides the sole force by which treatment agent is applied to the fabric. During treatment, the fabric remains stationary on the spool on which it is stored. The techniques taught by Aurich and Christ may be suitable for processing long lengths of fabric, but these techniques are unsuitable for the treatment of finished garments or small fabric work pieces since these cannot be easily formed into endless rope form or wound onto spools. Further, the practice of the processes taught by Aurich and Christ require special equipment which many clothing manufacturers do not have.

U.S. Pat. No. 4,432,111 to Hoffmann et al. teaches a procedure for washing textiles in a tub-type washing machine using reduced quantities of water compared with conventional textile washing procedures. The tub is driven at a velocity resulting in at least 0.2 g of centrifugal force causing the textiles therein to repeatedly be lifted up and then fall in a trajectory onto the lower portion of the tub. Washing liquid is applied to either the lower portion of the tub, or sprayed into the tub until the textiles are wetted with a quantity of washing liquid equalling 45–100% of the maximum amount which the textiles can absorb. Upon completion of the washing cycle most of the washing liquid is discharged by spinning the inner drum. Rinsing is accomplished in the same manner as washing. The Hoffmann process has the following disadvantages: (1) the process may result in run off of nonabsorbed liquid, thus resulting in a lack of treatment reproducibility between different batches of textiles or non-uniform exposure to treatment agents within a batch, (2) absorption of at least 45% of the maximum which the textiles can absorb resulting in processing inefficiencies to remove the water upon completion of the treatment, and requiring treatment of the waste water, (3) drum velocity resulting in at least 0.2 g centrifugal force compacting the textiles and thus preventing uniform exposure of all textiles surfaces to treatment agent when this is used in small quantities and (4) using a spray which produces a liquid stream which can impact and react with isolated portions of the textiles, producing a non-uniform application of a treatment agent when small quantities of treatment agent are utilized.

Accordingly, the need exists for a treatment technique for garments wherein the desired chemical or physical change can be obtained using conventional equipment without the use of abrasive particles, and with minimal quantities of processing chemicals and water.

SUMMARY OF THE INVENTION

The present invention provides an apparatus and a method for applying processing chemicals to garments or garment work pieces. The apparatus includes a housing, a means for tumbling garments in the housing, and a nozzle means for generating a fine mist or fog of aqueous solutions or dispersions of treatment agents inside the housing. The apparatus can be constructed as a dedicated processing machine, or a conventional washer or dryer can be modified by fitting with an appropriate nozzle means and feed lines to provide a dual purpose machine which can be used for its originally intended purpose, and can be selectively used for treating garments or garment work pieces in a chemical fog or mist. Uniform coverage of the surface of the garment is assured by tumbling the garments through the fog created by the nozzle means. By controlling the size of the droplets, and the time during which mist or fog is generated, the amount of chemical agent applied on the garments can be controlled and waste (chemical agent not absorbed by the garments) can be substantially or completely eliminated. The use of the finely divided, air dispersed liquid agent permits the use of relatively concentrated liquid chemical agents which heretofore required significant dilution before use in order to avoid unsightly, random local alterations to the garment finish. A wide variety of chemical processing agents can be used, such as, for example, fabric softeners, anti-ozonate compounds, dyes, bleaches, and enzymes.

In one embodiment, the present invention provides a finishing apparatus for applying aqueous solutions or dispersions of textile treatment agents to garments. An apparatus of this embodiment can include a conventional, industrial washer or dryer having a liquid impermeable stationary cylindrical outer drum and a horizontal, perforated cylindrical inner drum. The inner drum is typically mounted for rotation inside the outer drum. A door is provided in the outer drum for loading and unloading of garments. Such a conventional washer or dryer can be modified by mounting one or more atomizing spray nozzles to create a fog or fine mist inside the inner drum. Garments are treated by tumbling either dry or damp garments through the mist or fog for a predetermined time, using a predetermined quantity of textile treatment agent. Following treatment the garments can be processed further or dried.

In a further embodiment, the present invention provides a method of applying aqueous solutions or dispersions of textile treatment agents in a way which minimizes the garment treatment disadvantages associated with immersion treatments. A method of this embodiment includes tumbling either dry or damp garments inside a drum in which a mist or fog of aqueous treatment agent is created and maintained by atomizing nozzles mounted inside the drum housing. Mist spraying and garment tumbling is continued until a pre-calculated amount of treatment agent has been added sufficient to achieve the desired effect. The garments can then be subjected to other processes or dried.

Other objects, features, advantages and embodiments of the present invention will become apparent to one skilled in the art from reading the Detailed Description of the Invention together with the drawings.

Brief Description of the Drawings FIG. 1 is a perspective view of a conventional, front-loading washer or dryer modified according to a preferred embodiment of the present invention;

Detailed Description

Figure 1:
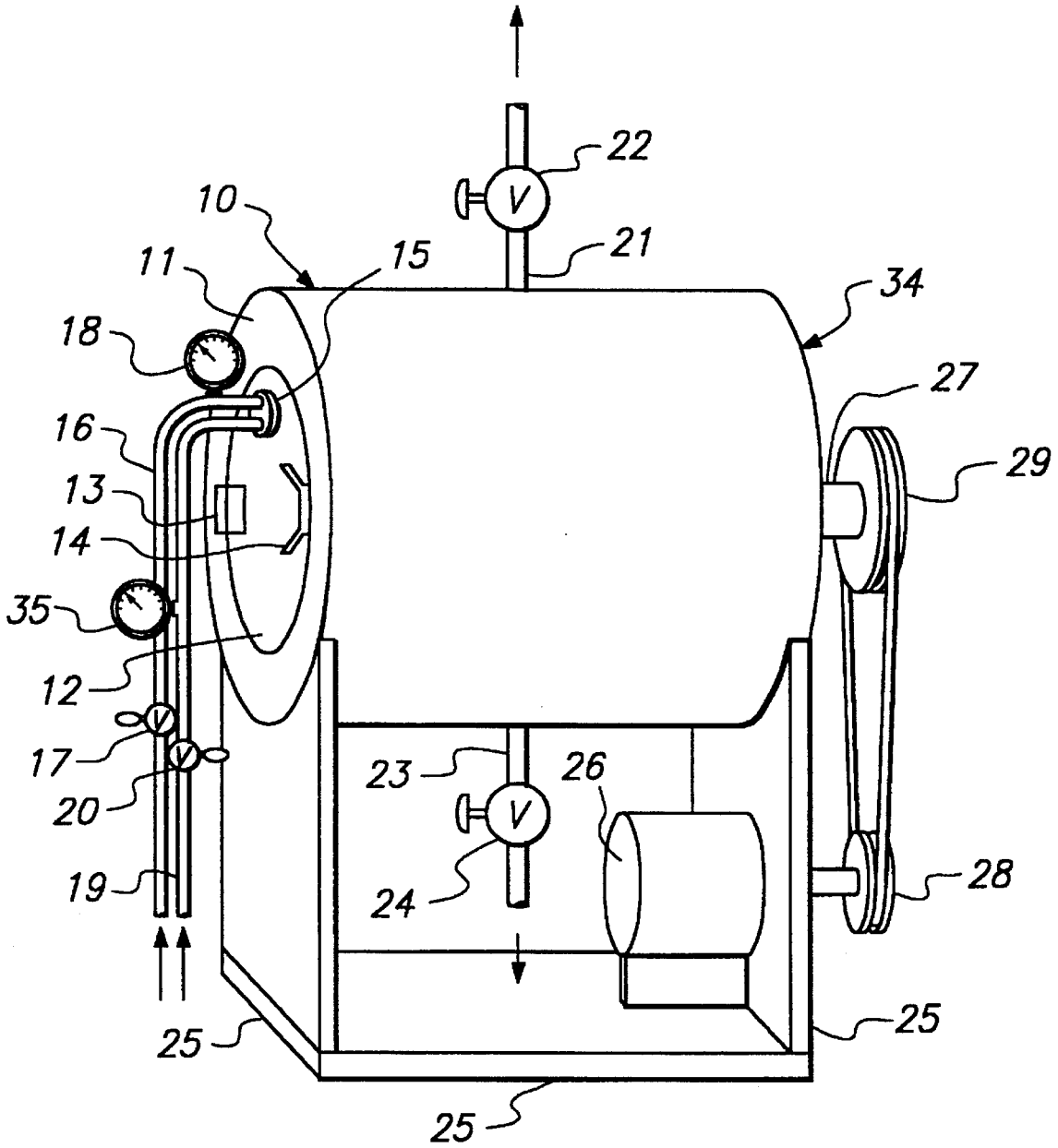
Figure 2:
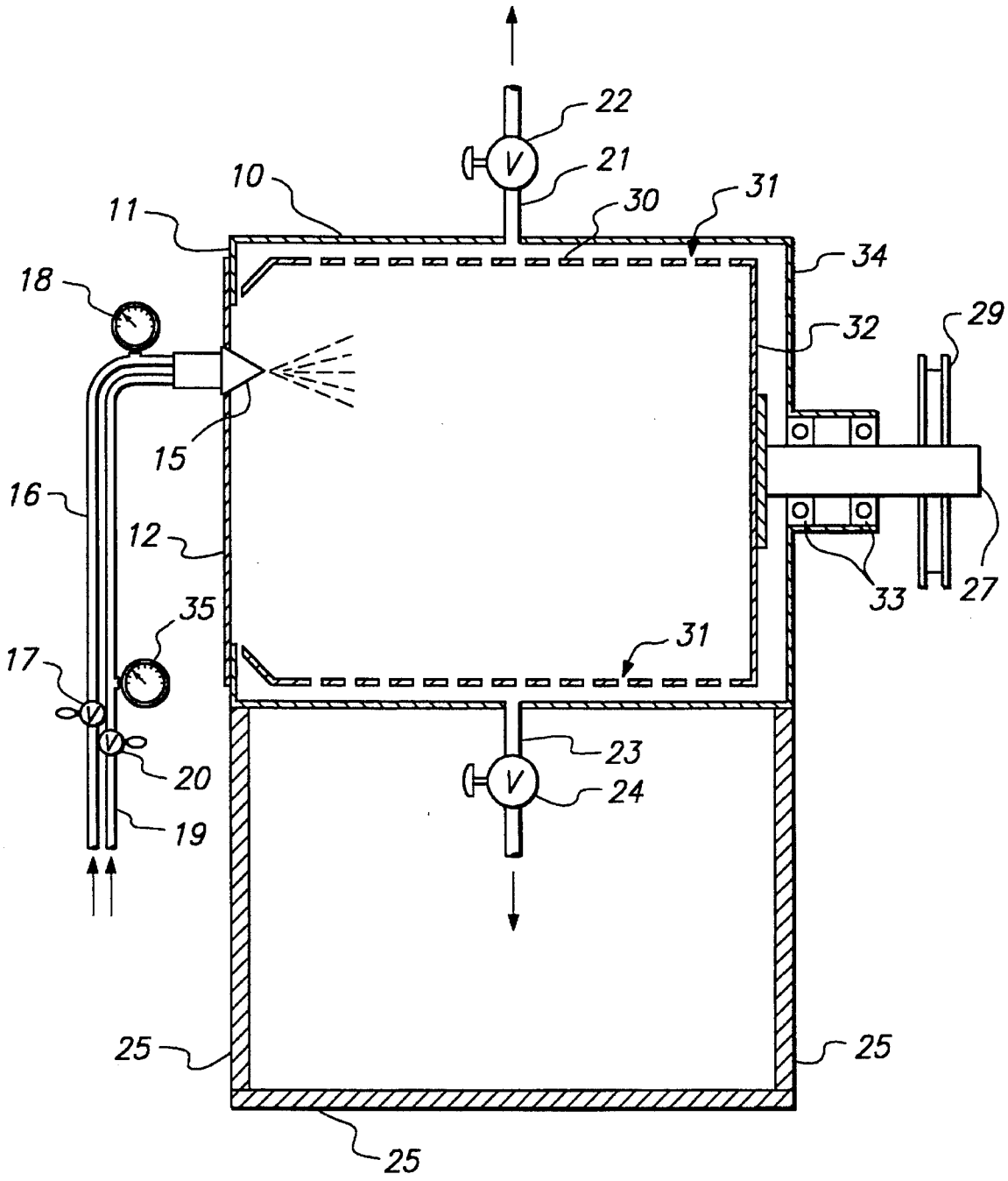
FIG.2 is a cross-sectional view of the device illustrated in FIG.1.

FIG. 1 shows a fabric tumbling device, such as a conventional or industrial washer or dryer, including a housing 10 which is relatively liquid impermeable. Housing 10 is typically provided with a front end 11 having an access door 12 for loading and unloading of garments. Access door 12 can be provided with a hinge 13, or other conventional structure, to facilitate opening and closing. A door fastener 14 is also typically provided to prevent accidential opening of the door while the washer or dryer is in operation. Positive locking of access door 12 is particularly preferred for large fabric tumbling devices, such as large capacity industrial washers and dryers, for safety reasons. Housing 10 can be supported by a support stand 25. A motor drive 26 can be provided to conventionally rotate inner drum 32 (as shown in FIG. 2), which is attached to shaft 27. This can be done, for example, and as shown in FIG. 1, conventionally by means of pulleys 28 and 29 which connect shaft 27 to the output shaft of motor drive 26. Many other alternative arrangements are possible for mounting the motor drive 26 to rotate inner drum 32, including, for example, mounting the inner drum directly to the motor output shaft.

An atomizing spray nozzle 15 can be mounted through the access door 12 to provide a mist or fog of textile treatment agent inside the housing 10. Nozzle 15 is preferably a high velocity, low pressure (HVLP) type atomizing nozzle assembly, such as that manufactured by, for example, Spraying Systems Co. and sold as their Model #½" JBC-SS Back Connect nozzle. Attachments can be added to vary the shape of the fog pattern produced by the nozzle. For example, Spraying Systems, Inc. provides screw-on attachments in its spray setup numbers SU70, SUE75 or SU380C which provide a round, flat, and circular pattern respectively. Nozzle 15 can be constructed from any suitable material, such as, for example, stainless steel, and is typically constructed to receive feed lines having ⅛ inch to ¾ inch or larger diameters. The most preferred line size, for use with the present invention in a high capacity industrial finishing machine, is ½ inch diameter.

Gas conduit 16 provides pressurized air to spray nozzle 15. Air pressure is regulated conventionally by a control valve 17 to a pre-selected value which is measured at pressure gauge 18.

Aqueous solutions or dispersions of treatment agent are placed in a reservoir (not shown) outside the washer or dryer. This reservoir is preferably located below and aligned with the spray head. It is preferred to provide a means for heating the treatment agent in the reservoir, to enable the user, when desired, to offset the adiabatic cooling of the textile treatment agent caused by the action of the atomizing nozzle. The treatment agent reservoir is also preferably pressurized using conventional means, such as a pump, to between about 1 psi to about 50 psi. The flow of treatment agent through feed line 19 to the nozzle 15 is controlled by control valve 20 and measured by gauge 35. Air and treatment agent is thus provided to the nozzle 15 under pressure, and mixed in the nozzle 15, to provide a substantially completely atomized spray which, under normal processing conditions, leaves substantially no residual liquid in the bottom of housing 10. The flow rate from the reservoir is directly related to pressure: liquid flow to the nozzle 15 will increase as fluid pressure increases. Thus, higher fluid pressure will require higher air pressure to the nozzle 15 to obtain proper mixing to create a fog. For example, when the Spraying Systems Co. Model JBC-SS Back Connect nozzle (adapted to receive ½ inch feed line) is used with the Spraying Systems Co. SUE-75 spray attachment, and the liquid pressure is set to 30 psi liquid pressure, a fog will be created when the air pressure is set to 80 psi of air pressure. Under these conditions, the calculated median volumetric diameter of the droplets produced is 137μ.

In the preferred embodiment, gases are vented from the housing 10 through a conventional conduit, or through a conduit 21 which can be provided with a valve 22 for opening or closing conduit 21. This allows the operator to either exhaust the gases or to recycle the gas used for entraining the textile treatment agent in a substantially closed system.

A conventional washer is typically provided with a drain 23 which is controlled by a drain valve 24, for allowing the drum to fill with cleaning liquids (when the valve 24 is closed) and for allowing cleaning liquids to drain (when the valve 24 is opened) during conventional, immersion washing or rinsing. It should be apparent that these components are not necessary for the practice of this invention, but may be convenient and useful if it is desirable to wash the garments immediately after processing according to this invention. In that event, using a washer as the tumbling device would be most preferred.

FIG. 2 shows a cross-sectional view of a preferred embodiment of the present invention as shown in FIG. 1, omitting (for clarity) the motor drive 26. The preferred embodiment includes an inner drum 30 mounted for rotation inside the housing 10. Inner drum 30 is preferably cylindrical in shape, and the sides of inner drum 30 can include perforations 31. A shaft 27 is preferably provided centered on the back end 32 of inner drum 30 for rotating the drum 30. Bearings 33, which form a rotary union, allow shaft 27 to rotate freely through back end 34 of housing 10. Bearings 33 preferably provide a substantially water impermeable seal, and are preferably substantially aligned with the horizontal axis of rotation of inner drum 30.

Access to the interior of inner drum 30 is obtained by releasing door fastener 14 and opening access door 12. In the embodiment shown in FIG. 2, one or more stationary atomizing spray heads 15 can be mounted through access door 12 to create an atomized mist or fog for garment processing inside the inner drum 30. In this embodiment, access door 12, and the attached spray head 15, remain stationary during operation while the inner drum 30 rotates.

Figure 3:
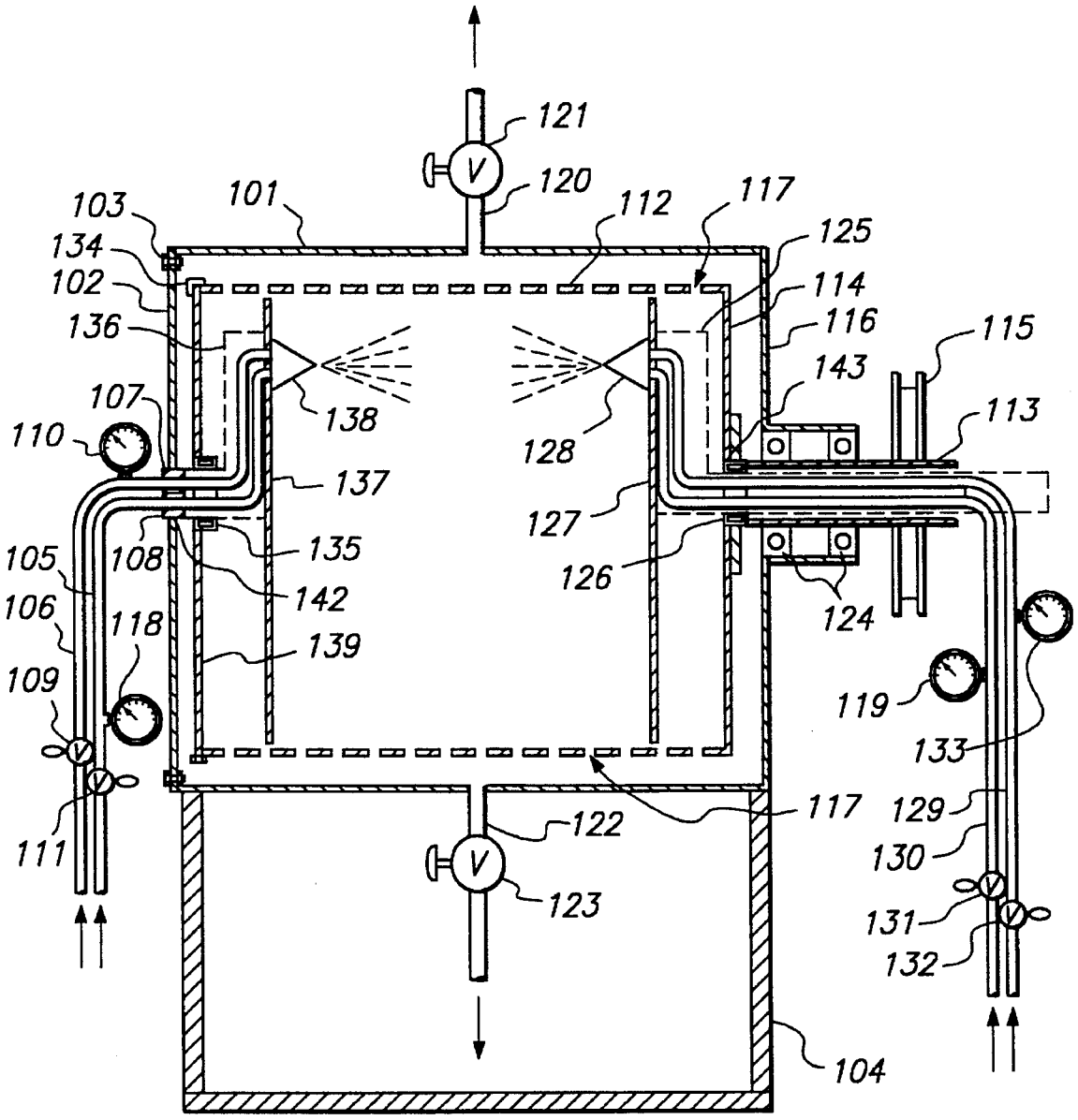
FIG.3 is a cross-sectional view of a conventional washer or dryer showing an alternative embodiment of the present invention.

Another embodiment of the present invention, using one or more spray heads 128, 138 mounted inside a rotating inner drum is illustrated in FIG. 3. In this embodiment, a substantially liquid impermeable housing 101 is provided with a front end door 102 closed by fastener 103. Housing 101 is supported by base 104.

A rotating inner drum 112, which may be provided with perforations 117, is mounted for rotation on hollow shaft 113 which passes through an opening in the rear 116 of housing 101. Bearings 124, which form a rotary union, allow shaft 113 to rotate in stationary housing 101. Bearings 124 permit free rotation of shaft 113 and seal the opening in the rear wall 116 of housing 101 through which shaft 113 passes. Bearings 124 are preferably substantially aligned with the horizontal axis of rotation of inner drum 112. Rotation of shaft 113 can be accomplished, for example, through pulley 115 which can be connected by a belt or a shaft drive (not shown) to a motor (not shown) in an arrangement similar to that depicted in FIG. 1. As shown in FIG. 3, rotating inner drum 112 can be provided with a door 139 which is mounted on hinges 134 to permit the door 139 to be selectively opened and closed to load and unload garments for processing. A lock (not shown) can be provided for securing door 139 in a closed position during operation.

Air conduit 105 and liquid conduit 106 can be securely mounted in opening 142 of door 102 using fittings 107, 108. A bearing 135 substantially aligned with the horizontal axis of rotation of the inner drum can be provided through inner door 133 to permit the inner drum to rotate about the stationary conduits 105, 106. Stationary conduits 105, 106 terminate in a stationary nozzle 138 which can be mounted along the axis of rotation, or, alternatively, may be mounted offset as shown in FIG. 3 and described in more detail below.

Likewise, air conduit 129 and liquid conduit 130 pass through hollow shaft 113 which preferably extends through and is mounted to an opening 143 in rear wall 114. A bearing 126 substantially aligned with the axis of rotation of inner drum 112 can be provided in rear wall 114 (or in a second door mounted in the rear of the drum) to permit the inner drum 112 to rotate about the stationary conduits 129, 130. Stationary conduits 129, 130 terminate in a stationary nozzle 128 which can be mounted along the axis of rotation or, alternatively, may be mounted offset as shown in FIG. 3 and described in more detail below.

The conduits 16, 19, 105, 106, 129 and 130 can be selected from any suitable conduit material capable of withstanding the pressures described herein. Preferably, the conduits are formed from polyethylene tubing having an inside diameter ranging from about ⅛ inch to about ½ inch. Most preferably, conduits 19, 105 and 130 are transparent to provide a visual indication of the presence of textile treatment agent in these conduits.

Flow of pressurized air through air conduits 106, 129 can be regulated by regulating valves 109, 132 to a pre-selected value which is measured at air pressure gauges 110, 133 respectively. Flow of liquid treatment agent through conduits 105, 130 is regulated by valves 111, 131 to a preselected value which is measured at gauges 118, 119 respectively. Gases are preferably vented from housing 101 through a conventional venting arrangement depicted schematically as conduit 120 and valve 121. Alternatively, a closed system can be obtained by recycling the propellant air used to create the treatment fog.

If a conventional washing machine is selected as the tumbling mechanism, and is used conventionally to wash the garments after processing, washing liquids can be removed through conduit 122 and valve 123 as described above.

One or more atomizing spray nozzles can be provided adjacent to the rear wall 114 of the inner drum 112. Most preferably, the nozzles 128, 138 are mounted along, and centered substantially on, the center of the axis of rotation of inner drum 112. Alternatively, however, nozzles 128, 138 could be mounted off-center from the axis of rotation of the inner drum as shown in FIG. 3. Because this means the conduits 105, 106 and 130, 129 will be inside the rotating inner drum, a structure should be provided to prevent the conduits from ensnaring tumbling garments and thus preventing the even treatment of the ensnared garments by the treatment mist.

For example, a bracket 125, 136 can be provided along the conduits 105, 106 and 130, 129. As shown in FIG. 3, brackets 125, 136 pass through the openings formed in the front 102 and rear 116 of housing 101. Bearing 126 is substantially aligned with the horizontal axis of rotation of inner drum 112, and is mounted in back end 114 of inner drum 112. Bearing 126 rotates with the inner drum, thus enabling bracket 125 to remain stationary when inner drum 112 rotates. Likewise, a bearing 135 substantially aligned with the horizontal axis of rotation of the inner drum can be provided through inner door 133. Thus, when bracket 136 is mounted through bearing 135, bracket 136 will remain stationary when the inner drum rotates.

The bracket 125, 136 can also be used to provide a structure to which a stationary panel 127, 137 can be mounted inside rotatable inner drum 112. In the embodiment shown in FIG. 3, a panel 127, 137 is mounted on bracket 125, 136 so as to be substantially parallel and in close proximity to each end of inner drum 112 to prevent tumbling garments from coming into contact with the liquid and gas conduits feeding the spray heads 128, 138. The outer edge of each panel 127, 137 follows the contours of the cylindrical wall of inner drum 112 without contacting the wall. The atomizing spray nozzles 128, 138 can be mounted on the panels 127, 137, for example, as shown in FIG. 3. The space inside bearings 126, 135 through which the brackets 125, 136 and conduits 105, 106, 129 and 130 pass, preferably provide a substantially liquid impermeable seal. As will immediately be understood by one having skill in the art, brackets 125, 136 must be very strong and stable to withstand the motion of the inner drum and the tumbling action of the garments during processing.

The preferred embodiments described above illustrate a two drum arrangement, with a rotating inner drum and a stationary outer drum, since this is the typical configuration of most conventional, industrial washers or dryers which are possessed and used by most garment manufacturers. However, a single drum washer or dryer, such as that disclosed in U.S. Pat. No. 4,941,333, could easily be modified by one skilled in the art using the disclosure in this application to produce an apparatus of the present invention. Likewise, a chamber could be constructed that either (1) rotates itself, or (2) has a rotating perforated drum or basket within it, for tumbling garments in the presence of a fog or mist of treatment agents created within the chamber.

Dry or damp garments are preferably processed in a device of the present invention as depicted in FIGS. 1–3. "Damp" means the garments have absorbed during other processing steps moisture of no more than about 125% of dry weight. Garments can be processed using the method of this invention in the following way:

A textile treatment agent reservoir is filled with a solution or dispersion of the desired textile treatment agent to be applied to the garments. These typically include fabric softeners, anti-ozonate compounds, permanent-press type fabric finishes, bleach, potassium permanganate solution, dyes, or other chemical agents. If the temperature of the textile treatment agent is important, it should be heated. This can be done, for example, by heating the solution or dispersion of textile finishing agent to the desired temperature and placing it in the reservoir just prior to beginning the finishing process, or by heating the solution or dispersion of textile finishing agent in the reservoir using a heating element. Because adiabatic cooling will reduce the temperature of the solution fog when it contacts the garments (depending on the pressure drop of the liquid as it exits the nozzle), the temperature of the solution or dispersion in the reservoir should be somewhat higher than that desired at the point of contact with the garments. The reservoir is also preferably pressurized to a pressure which can range from about 1 psi to about 50 psi.

A pre-determined quantity of dry or damp garments is placed inside inner drum 32/112, the door is then closed and fastener 14/103 is engaged. Motor drive 26 is engaged to rotate the inner drum, at a speed ranging from about 10 revolutions per minute (rpm) to about 35 rpm, and more preferably from about 20 rpm to about 30 rpm. Inner drum rotation at this speed causes the garments to tumble inside inner drum 32/112. Preferably, the garments are tumbled for a short period of time before fog generation begins. If a modified dryer is being used to carry out the procedure, the pretumble can be used to bring the equipment and garments to a uniform temperature before the generation of treatment fog begins. This temperature can be any temperature within the operating capabilities of the equipment. Such temperature equilibration can also help offset the adiabatic cooling of the treatment agent during atomization.

To generate the treatment agent fog, valves 17/109, 20/111, 131 and 132 are opened and adjusted to provide air or other entraining gas to the spray nozzle at a preselected pressure. Air pressure is measured at pressure gauge 18/110 and 133. A preferred range of air pressure is about 40 psi to about 80 psi, but can range up to about 100 psi.

The flow of pressurized liquid to the nozzle is regulated by adjusting liquid control valve 20/111, 131, and measured by gauge 35/118, 119 to a range of about 10 psi to about 40 psi. Preferred liquid flow rates are about 1–3 gallons per minute. However, the process will work at flow rates as low as about 0.05 gallons per minute to as high as about 10 gallons per minute.

The entrainment of the textile treatment agent in the gas stream by the nozzle creates a mist or fog of treatment agent inside the inner drum. As garments are tumbled in the inner drum, they are uniformly exposed to the treatment agent. Valve 22/121 can be opened during mist spraying to vent the air introduced through the spray nozzle. A predetermined quantity of treatment agent is applied to the garments by tumbling them in the mist for a period of time.

Mist can be generated either continuously or at intervals while the garments are tumbled. For example, using an interval method, the garments could be tumbled for 30 seconds during mist production, tumbled for 60 seconds without mist production, followed by 30 seconds of mist production and so on. If only the desired amount of textile treatment agent is placed in the reservoir, and if a transparent conduit is used for the conduits 19/105, 130 the end of the treatment will be signalled by the absence of liquid in these conduits. When the desired quantity of treatment agent has been added, the valves 17/109 and 132 are closed to stop the flow of air and liquid to the nozzles 15/138 and 128. Following the generation of mist, the garments are tumbled for a period ranging from about one minute to about ten minutes to evenly distribute to the tumbling garments the chemical agent fog remaining in the housing, and to evenly distribute the moisture absorbed by the garments between the garments. Garments treated according to this process typically absorb textile treatment agents in an amount ranging from about 5% up to about 100% of their dry weight, and very likely could absorb up to about 150% of their dry weight in textile treatment agents, depending upon the cloth used in producing the garment or garment work piece and the desired finish. The garments may then be subjected to other processes or may be dried.

The quantity of treatment agent applied to, and absorbed by, the garments is controlled by the flow rates and time of treatment. The quantity of treatment agent required to achieve a particular result can be easily determined by simple experimentation, and depends upon the concentration of the liquid agent used, its ability to affect fabrics, the type of fabric used to construct the garments, the starting color and "hand" of the garments, and the final finish desired.

The following examples are provided to illustrate the process described above. It is not intended, in any way, to limit the present invention:

EXAMPLE 1

A Milnor Model 450 Washing Machine was fitted with a Spraying Systems Co. Model No. ½JBC-SS Back Connect Nozzle modified for open and flat spray using a Spraying Systems Co. SUE75 adapter, mounted to be substantially aligned with the axis of rotation of the washer drum. 200 pounds of cotton, canvas trousers were loaded in the drum. 200 pounds of an aqueous solution containing cross-linking, easy care (e.g., permanent press type) fabric finish was prepared and loaded into a chemical reservoir. Tumbling began, with tumbling speed at 30 rpm. Air pressure was set to 80 psi. Liquid flow rate at ambient pressure was set to 25 pounds per minute. After 6 minutes, atomizing was discontinued and tumbling continued for a total of 10 minutes. At this point, the door was opened and the garments checked for moisture distribution. Of the 160 pounds of solution used, 150–154 pounds was absorbed by the garments (about 75–77% of the garments' dry weight). There was no residual liquid in the bottom of the washer drum. Following treatment, the garments were transferred to a dryer and dried at 180 degrees to remove all but 10–12% of the moisture, followed by a 10 minute cool down. The treated garments were then pressed followed by curing at 320 degrees for at least 6 minutes to react the fabric finish. Uniform coverage was obtained, with a result equivalent to that which we previously obtained using a prior, conventional immersion process used for applying the same easy care fabric finish. Use of the prior, conventional immersion process typically required the preparation and use of 1600 pounds of the same liquid fabric finish solution.

EXAMPLE 2

A Unimac washer model no. UY230 having a sample port was modified by placing a metal bracket into the washing machine drum through the sample port. A Spraying Systems Co. Model ¼" JBC-SS Back connect nozzle was fitted to an air line and a liquid line using swagelok precision instrument fittings (¼" NPT to ¼" tube stainless steel male connector). The air line and liquid line were formed from polyethylene tubing rated for up to 90 psi and having an inside diameter of 0.295" and an outside diameter of 0.375" The liquid and air lines were attached to a Binks pressure spraying reservoir with a 2 gallon capacity. The reservoir includes two air gauges: one measures the pressure of the air entering the vessel, and the other measures the pressure being induced to the liquid. These gauges are controlled by regulating valves, with the incoming air valve being a ball valve to enable even introduction of air into the vessel. 4 kg of an aqueous solution containing 200 grams of a cationic, polyethylene softener was placed in the reservoir. The incoming air regulating valve was adjusted to provide 80 psi of incoming air and the outgoing regulating valve was adjusted to provide 20 psi of liquid pressure. Incoming air was provided from a standard compressor which can furnish air at 120 psi. 5 kg of 100% cotton denim garments was loaded into the washer, and rotation of the inner drum was commenced at 30 rpm. Atomization was commenced by opening control valves leading to the nozzle, and was continued until there was no more liquid flowing through the liquid feed line. The control valves were closed, and the process was completed by tumbling for 2 minutes. The garments actually gained about 77% of their dry weight during the process. The garments were removed and completely dried in a conventional dryer. The final product was examined visually and by feel, and found to match or exceed current production standards using immersion techniques.

EXAMPLE 3

800 grams of 100% cotton natural denim (no indigo or dyes) was placed in a Unimac Model No. UY18 washer. These were conventionally pre-washed and extracted to about 60% moisture. A 0.5% solution of dye was prepared by mixing 2 liters of water with 4 grams of Remazol Navy RGB and 10 grams of 50% NaOH. The pH of the solution was measured at 11.6. The dye solution was heated to a temperature of 180 degrees fahrenheit. Two liters of the heated dye solution was loaded into the reservoir. The garments were tumbled at 30 rpm, and air and liquid pressure was set at 50 and 20 psi respectively. Mist generation began after a few minutes of pretumbling, and was continued until the dye solution was exhausted. Tumbling continued for two minutes after the air and liquid valves were turned off. The washer was opened and distribution of the dye mist was checked. Conventional washing was then employed to complete the dyeing process.

By using the method and apparatus of this invention, a wide variety of fabric finishes can be advantageously applied to provide a permanent-press type easy care finish, or a uniform worn/soft look without the use of abrasive particles, or to apply a dye or other fabric finish. The method and apparatus of the present invention allows significant savings of water and processing chemicals. Further, the method and apparatus of the present invention, particularly when used with bleaches or dyes, should provide unique "looks" not hitherto producable by conventional means. The present invention achieves these results by creating a mist or fog of textile treatment agent and tumbling dry or damp garments or fabric work pieces through the treatment fog.

One skilled in the art will recognize that it would be possible to construct the elements of the present invention from a variety of materials and to modify the process in a variety of ways. While the preferred embodiments have been described in detail and shown in the accompanying drawings, it will be evident that various further modifications are possible without departing from the scope of the invention as set forth in the following claims.

We claim:

1. A method for applying a textile treatment agent to garments or garment work pieces using an apparatus having a substantially liquid impermeable housing, a means for tumbling garments placed in the housing, a stationary nozzle means mounted in said housing for creating a fog of textile treatment agent, a gas conduit for communicating a propellant gas from a gas source to said nozzle means, a liquid conduit for communicating the liquid textile treatment agent under pressure from a reservoir to said nozzle means, said method comprising the steps of:

tumbling garments in the liquid impermeable housing; and causing gas to flow through the gas conduit to the nozzle under pressure, and causing a predetermined quantity of liquid textile treatment agent to flow through the liquid conduit to the nozzle under pressure, to create in the housing a fog of the textile treatment agent, whereby as said garments or garment work pieces are tumbled through said textile treatment agent fog they dissipate the fog by substantially uniformly absorbing substantially all of said textile treatment agent.

2. The method of claim 1 wherein the textile treatment agent is a solution or dispersion including one or more from the group consisting of fabric softeners, permanent-press type finishes, dyes, and bleaches.

3. The method of claim 1 wherein said garments absorb chemical treatment agent in an amount ranging from about 5% to about 100% of their dry weight.

4. The method of claim 1 wherein the textile treatment agent is pressurized to about 20–50 psi.

5. The method of claim 4 wherein the air conduit furnishes air at 20–100 psi to the nozzle.

6. The method of claim 5 wherein the median droplet size produced during generation of the textile treatment fog is about 137 microns.

7. The method of claim 1 wherein said tumbling is carried out in a conventional washer or dryer which rotates at a speed ranging from about 10 revolutions per minute to about 35 revolutions per minute.

8. A method for applying a textile treatment agent to garments or garment work pieces comprising the steps of:

placing the garments or garment work pieces in a tumbling means contained within a liquid impermeable housing;

intermittently activating a fog generation means for creating a fog of liquid textile treatment agent within said liquid impermeable housing, said fog comprised of liquid droplets having a median diameter of about 137 microns;

tumbling said garments or garment work pieces through said fog to uniformly dampen said garments or garment work pieces; and continuing said fog generation and tumbling until a predetermined quantity of said liquid textile treatment agent has been consumed, said predetermined quantity being sufficient to treat said garments without creating substantial residual liquid in said liquid impermeable housing.

9. The method of claim 8 wherein said fog generation means is a high velocity, low pressure nozzle, and wherein said fog is generated by causing gas to flow under pressure through a first conduit to said nozzle and causing said liquid textile treatment agent to flow under pressure through a second conduit to said nozzle.

10. The method of claim 9 wherein said gas is pressurized to a range of about 20 psi to about 100 psi and said liquid textile treatment agent is pressurized to a range of about 20 psi to about 50 psi.

11. The method of claim 7 wherein said garments are tumbled in a perforated basket which rotates at a speed ranging from about 10 revolutions per minute to about 35 revolutions per minute.

12. The method of claim 7 wherein said liquid textile treatment is a solution or dispersion including one or more from the group consisting of fabric softeners, permanent-press type finishes, dyes, and bleaches.

13. The method of claim 7 additionally including the step of heating the liquid textile treatment agent before creating said fog.

14. A method for applying a finishing treatment to newly constructed garments or garment work pieces which will be sewn together with other garment work pieces to create new garments, said method comprising the steps of:

tumbling the garments or garment work pieces in a liquid impermeable housing;

generating a fog of liquid textile treatment agent within said liquid impermeable housing, said fog comprised of liquid droplets having a median diameter of about 137 microns; and continuing said tumbling and fog generation until a predetermined quantity of said liquid textile treatment agent has been used and said fog has been dissipated by absorption by said garments or garment work pieces, said predetermined quantity being sufficient to uniformly treat said garments or garment work pieces to modify their look or feel without creating substantial residual liquid in said liquid impermeable housing.

15. The method of claim 14 wherein said fog is generated by causing gas to flow under pressure through a first conduit to a high velocity, low pressure nozzle and causing said liquid textile treatment agent to flow under pressure through a second conduit to said nozzle.

16. The method of claim 15 wherein the pressure of said gas is within a range of about 20 psi to about 100 psi and the pressure of said liquid textile treatment agent is within a range of about 20 psi to about 50 psi.

17. The method of claim 14 wherein said garments are tumbled in a basket which rotates at a speed ranging from about 10 revolutions per minute to about 35 revolutions per minute.

18. The method of claim 14 wherein said liquid textile treatment agent is a solution or dispersion including one or more from the group consisting of fabric softeners, permanent-press type finishes, dyes, and bleaches, and wherein the predetermined quantity ranges from about 5% to about 100% of the dry weight of the garments or garment work pieces being treated.

19. The method of claim 14 additionally including the step of heating the liquid textile treatment before creating said fog.

20. The method of claim 14 wherein said fog is generated intermittently.

* * * * *